US006508446B1

(12) United States Patent
Addison et al.

(10) Patent No.: US 6,508,446 B1
(45) Date of Patent: Jan. 21, 2003

(54) PORTABLE SWING SYSTEM

(76) Inventors: Julie H. Addison, 13923 Barryknoll La., Houston, TX (US) 77079; Rodger A. Addison, 13923 Barryknoll La., Houston, TX (US) 77079; Heather H. Lammers, 512 Corona, San Antonio, TX (US) 78209; Gerald E. Lammers, 512 Corona, San Antonio, TX (US) 78209

( * ) Notice: Subject to any disclaimer, the term of this patent is extended or adjusted under 35 U.S.C. 154(b) by 0 days.

(21) Appl. No.: 09/627,085

(22) Filed: Jul. 27, 2000

(51) Int. Cl.[7] ..... E04G 3/00

(52) U.S. Cl. ..... 248/218.4; 182/187; 248/219.4; 248/291.1; 248/230.1

(58) Field of Search ..... 248/218.4, 145, 248/317, 323, 339, 341, 230.1, 230.8, 241; 182/187, 142, 188; 108/135, 152

(56) References Cited

U.S. PATENT DOCUMENTS

| | | | | | |
|---|---|---|---|---|---|
| 1,337,089 | A | * | 4/1920 | Murray | 248/145 |
| 3,568,797 | A | | 3/1971 | Hardy | 182/142 |
| 3,937,463 | A | * | 2/1976 | Soisson | 248/341 X |
| 4,009,763 | A | * | 3/1977 | Hunter | 182/187 |
| 4,113,058 | A | * | 9/1978 | Kobosh | 182/145 X |
| 4,129,198 | A | * | 12/1978 | Hunter | 182/187 |
| 4,167,255 | A | * | 9/1979 | Benson | 248/218.4 |
| 4,484,660 | A | | 11/1984 | Baynum | 182/187 |
| 4,721,183 | A | | 1/1988 | Koniecka | 182/182 |
| 4,730,699 | A | | 3/1988 | Threlkeld | 182/187 |
| 4,886,143 | A | * | 12/1989 | Dubroc | 182/142 |
| 4,940,229 | A | | 7/1990 | Foster | 272/86 |
| 5,310,151 | A | | 5/1994 | Engel | 248/231 |
| 5,439,074 | A | * | 8/1995 | Trout et al. | 182/187 |
| 5,538,101 | A | | 7/1996 | Kempf | 182/116 |
| 5,649,257 | A | | 7/1997 | Kempka | 396/428 |
| 5,806,508 | A | | 9/1998 | Stempien et al. | 124/86 |
| 5,845,743 | A | * | 12/1998 | Dechant | 182/187 |
| RE36,276 | E | | 8/1999 | Smith | 182/187 |
| 6,053,190 | A | | 4/2000 | Brown, Jr. et al. | 135/90 |

OTHER PUBLICATIONS

International Search Report as Completed by ISA/EP on Nov. 22, 2001, in connection to International Application No. PCT/US01/23342.

* cited by examiner

*Primary Examiner*—Leslie A. Braun
*Assistant Examiner*—Tan Le
(74) *Attorney, Agent, or Firm*—Baker Botts, L.L.P.

(57) ABSTRACT

A portable swing system is provided for securing to a support, such as a pole or tree. The system comprises a vertical member adapted to be secured to the support and a horizontal member connected to the vertical member by a hinge. A swing depends from the horizontal member. Adjustable support bars are secured to the horizontal member and the vertical member. The adjustable support bars provide support during the swing cycle through alternating tension/compression cycles, depending on which side of the horizontal member the swing is located. The adjustable support bars may be moved along the vertical and horizontal members to maintain the horizontal member in a parallel relationship with the ground.

2 Claims, 6 Drawing Sheets

PORTABLE SWING SYSTEM

BACKGROUND OF THE INVENTION

1. Field of the Invention

This invention relates in general to swing systems and in particular to, a portable swing system designed to hang from any vertical structure.

2. History of the Prior Art

The swing set has been in use for many generations as a means for entertainment for children and adults alike. Though there have been many inventions pertaining to portable seats for use by hunters, outdoor campers, and the like, there has yet to be disclosed a portable swing system designed to withstand the alternating motions that follow a typical swing pattern.

SUMMARY OF THE INVENTION

The portable swing system of the present invention includes a vertical member adapted to be secured to a support, such as a tree or pole. To reduce wear on the support, a compressible foam pad is provided between the support and the vertical member. Adjustable straps are used to secure the vertical member to the support.

A horizontal member is connected to the vertical member by an adjustable hinge. Swing ropes for supporting a swing are secured to the horizontal member by clamps or other connection means.

A first adjustable support bar and a second adjustable support bar are provided for connecting the vertical member to the horizontal member. During a swing cycle, the support members operate in an alternating tension/compression cycle to reduce stresses on the vertical and horizontal members. The support bars may be bowed or straight, depending on the force requirement for the swing cycle. A plurality of support bar connection holes are spaced equally on the horizontal member and vertical member, respectively to adjust and secure the support bars to the horizontal and vertical member.

DETAILED DESCRIPTION OF THE DRAWINGS

Figure 1:
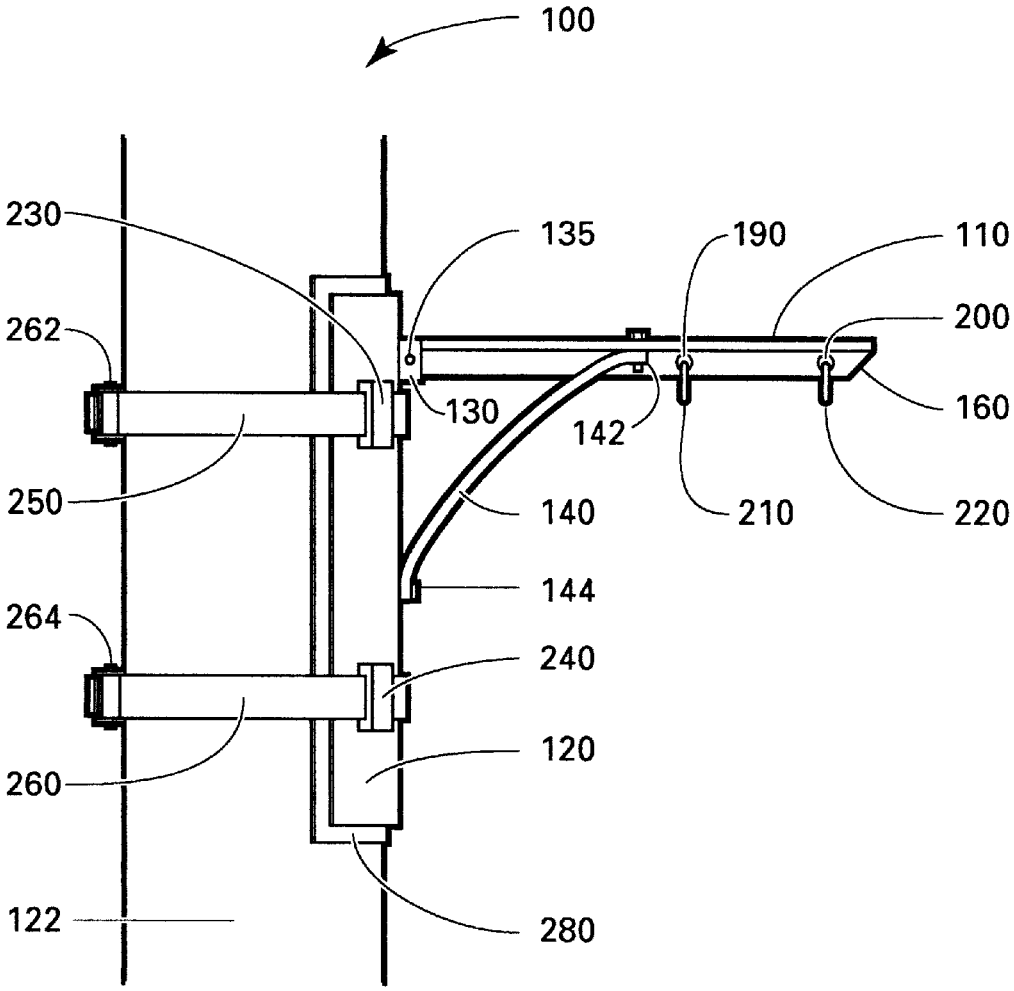
FIG. 1 shows a side view of a portable swing system of the present invention secured to a tree.
Figure 2:
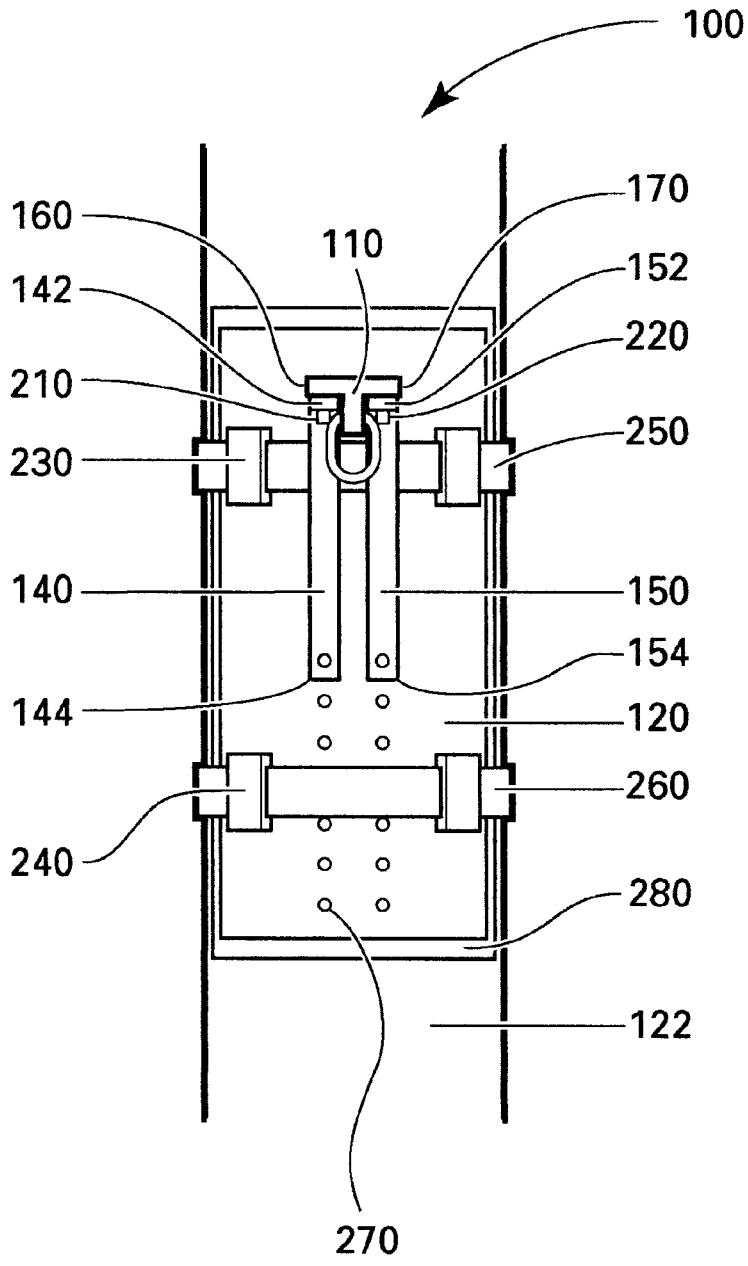
FIG. 2 is an end view of the portable swing system in FIG. 1.
Figure 3:
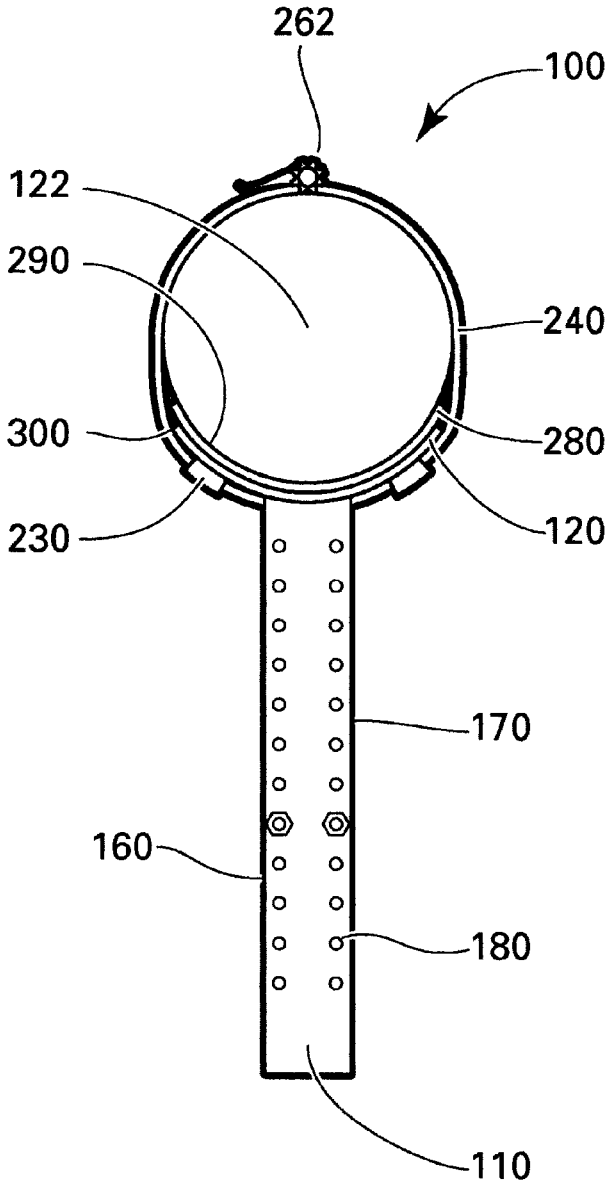
FIG. 3 is a top view of the portable swing system in FIG. 1.

As can be seen in FIG. 1, a portable swing system 100 comprises a horizontal member 110 and a vertical member 120. The horizontal member 110 and the vertical member 120 may be comprised of material such as metal, plastic, thermoplastic, or composites as long as the material is designed to support suspension and swaying forces associated with a typical swing set. In a preferred embodiment, the horizontal member 110 has a T-shaped cross-section as seen in FIG. 2. The vertical member 120 has an arcuate cross-section for wrapping around a tree 122 or other support structure such as a pole (not shown), best seen in FIG. 3. The horizontal member 110 is connected to the vertical member 120 at a fixedly adjustable hinge 130. The fixedly adjustable hinge 130 may be adjusted to assist in maintaining the horizontal member 110 in a parallel relationship with the ground. In the preferred embodiment, the fixedly adjustable hinge 130 rotates about a pivot point 135. Tightening means (not shown) may be used to hold the fixedly adjustable hinge 130, including a ratchet, a fastener, a weld, an interference fit, or a clamp. The horizontal member 110 is supported and further secured to the vertical member 120 by a first adjustable support bar 140 and a second adjustable support bar 150 in a parallel configuration best seen in FIG. 2. The first adjustable support bar 140 has a first end 142 and a second end 144. The first adjustable support bar 140 is secured at its first end 142 to a front side 160 of the horizontal member 110. Likewise, the second adjustable support bar 150 has a first end 152 and a second end 154, with its first end 152 secured to a back side 170 of the horizontal member 110.

Figure 5A:
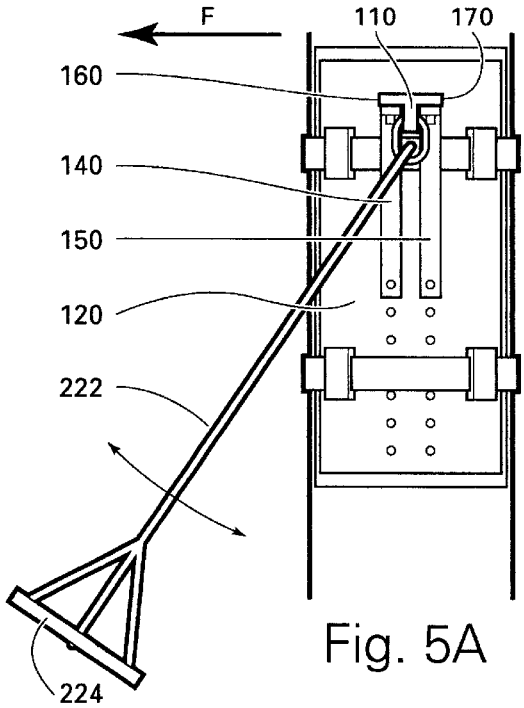
FIG. 5A is an end view of the portable swing system of FIG. 1 that details forces on the support bars when a swing is moving in a first direction.
Figure 5B:
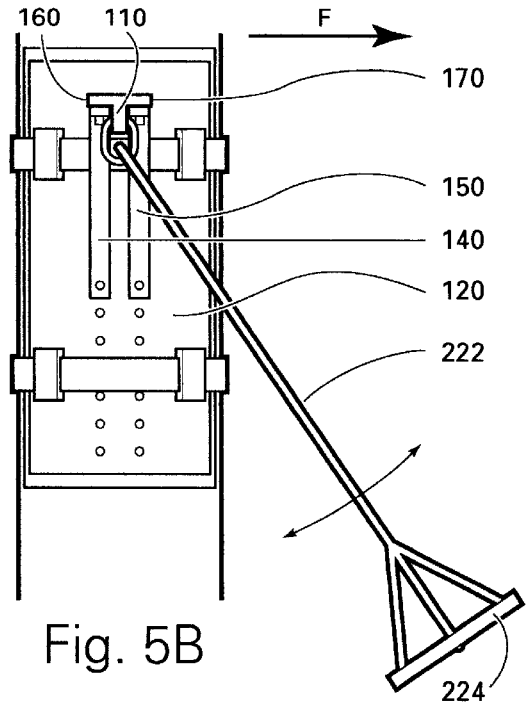
FIG. 5B is an end view of the portable swing system of FIG. 1 that details forces on the support bars when a swing is moving in a reverse direction of FIG. 5A.
Figure 5C:
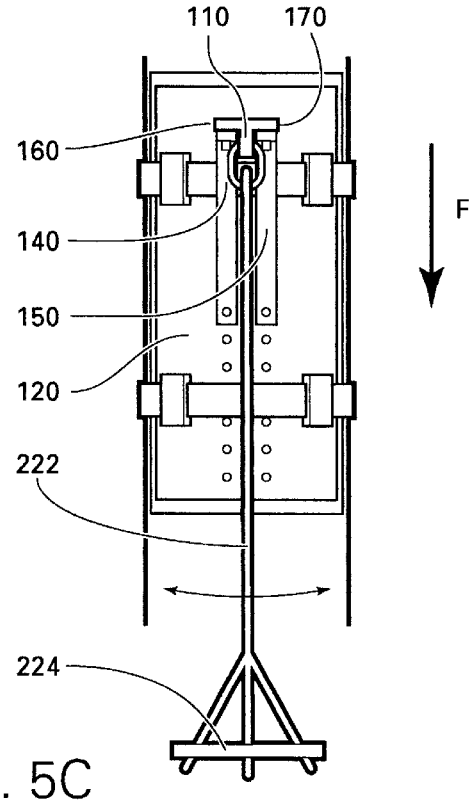
FIG. 5C is an end view of the portable swing system of FIG. 1 that details forces on the support bars when a swing is at rest.

For adjusting and supporting the swing system 100, the horizontal member 110 has a plurality of support bar connection holes 180 on the front side 160 and back side 170 for receiving the first adjustable support bar 140 and second adjustable support bar 150. The horizontal member 110 has a first link hole 190 and a second link hole 200 spaced laterally away from the tree 122 for receiving a first clamp 210 and a second clamp 220, respectively. Both first clamp 210 and second clamp 220 are designed to support a rope 222 which is secured to a swing seat 224 as shown in FIGS. 5A, 5B, and 5C.

The vertical member 120 has a pair of upper slots 230 and a pair of lower slots 240 for receiving a first adjustable strap 250 and a second adjustable strap 260, respectively. First and second adjustable straps 250, 260 may be adjusted to fit about tree 122 or any other standing member from which to mount the portable swing system 100. It is contemplated that instead of securing the vertical member 120 to the tree 122 via straps 250, 260, a plurality of teeth (not shown) may be provided on the vertical member 120 to engage the tree 122. Also, nail holes (not shown) may be added to the vertical member 120 to secure the swing system 100 to the tree 122.

The first and second adjustable straps 250, 260 may be tightened or loosened about the tree 122 by respective first and second ratchets 262, 264 as best seen in FIG. 1. The straps 250, 260 may be made of any suitable material, and may comprise metal chains. For further adjustment and support of the swing system 100, the vertical member 120 has a plurality of support bar connection holes 270 for connecting the second ends 144, 154 of the respective first and second adjustable support bars 140, 150 in varying parallel positions depending on the desired angle between the horizontal member 110 and vertical member 120.

Accordingly, the length of the adjustable support bars 140, 150 may vary to support obtuse angles between the horizontal member 110 and the vertical member 120. Between the tree 122 and vertical member 120 is a compressible foam pad 280 for preventing wear on the tree 122. The compressible foam pad 280 has a tree-facing side 290 and a swing-facing side 300. It is contemplated that other wear-reducing materials may be used to serve the same function as the compressible foam pad 280.

In operation, the portable swing system 100 is secured to a tree 122 by first placing the tree-facing side 290 of the compressible foam pad 280 against the desired location of the tree 122. The vertical member 120 is then placed on the swing-facing side 300 of the compressible foam pad 280. Next, adjustable straps 250, 260 are secured through the upper slot 230 and lower slot 240, respectively, and adjusted by first and second ratchets 262, 264 to prevent the vertical member 120 from moving in a vertical direction. The adjustment also functions to fixedly secure the vertical member 120 to the tree 122. If the straps 250, 260 are composed of metal, a lock or other securement method may be used to tighten the straps 250, 260. Next, the horizontal member 110 is secured at the fixedly adjustable hinge 130 to the vertical member 120. The desired angle between the vertical member 120 and horizontal member 110 is then set and fixed by the support bars 140, 150 to prevent the horizontal member 110 from moving relative to the vertical member 120 when supporting the swing seat 224. The fixedly adjustable hinge 130 functions to assist the support bars 140, 150 during the swing cycle.

Next, the first clamp 210 is secured into the desired first link hole 190 of the horizontal member 110, and the second clamp 220 is secured in the desired second link hole 200 of the horizontal member 110. The clamps may alternately comprise a D-clamp, a chain link with a threaded closure or any other type linkage necessary to support and secure the swing ropes 222 and swing seat 224 to the portable swing system 100.

Figure 4A:
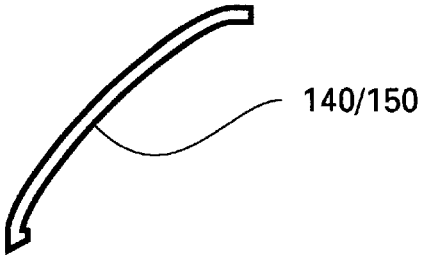
FIG. 4A is a side view of a support bar of the present invention.
Figure 4B:
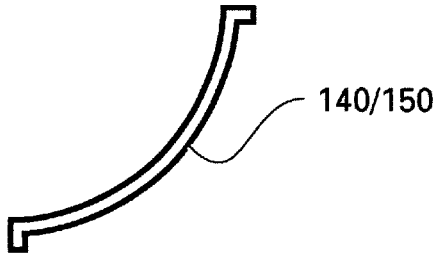
FIG. 4B is a side view of an alternate support bar of the present invention.
Figure 4C:
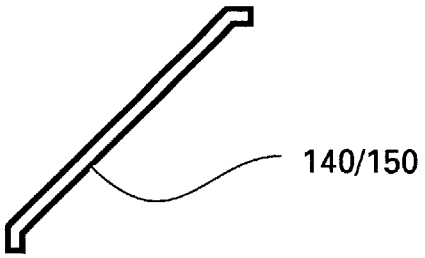
FIG. 4C is a side view of another alternate support bar of the present invention.

The first adjustable support bar 140 and second adjustable bar 150 may be comprised of bowed-in, bowed-out or straight bars as seen in FIGS. 4A, 4B and 4C, respectively. The first and second support bars 140, 150 act in an alternating compression/tension relationship when an individual is swinging on the swing seat 224 with an angular velocity about the horizontal member 110. As can be seen in FIG. 5A, when the swing seat 224 is on the front side 160 of the horizontal member 110 during the swing cycle, the first adjustable support bar 140 is in compression whereas the second adjustable support bar 150 is in tension. Conversely, as seen in FIG. 5B, when the swinger is on the back side 170 of the horizontal member 110 during the swing cycle, the second adjustable support bar 150 is in compression while the first adjustable support bar 140 is in tension. And finally as seen in FIG. 5C, when the swinger is suspending directly below the horizontal member 110, both the first adjustable support bar 140 and second adjustable support bar 150 are in compression.

The alternating tension/compression configuration provides additional support between the vertical member 120 and horizontal member 110, minimizes torsional forces at the interface of the vertical member 120 and tree 122, and helps ensure longer life of the components. Other resilient configurations of the first adjustable support bar 140 and second adjustable support bar 150 may be used to achieve the same function.

Figure 6:
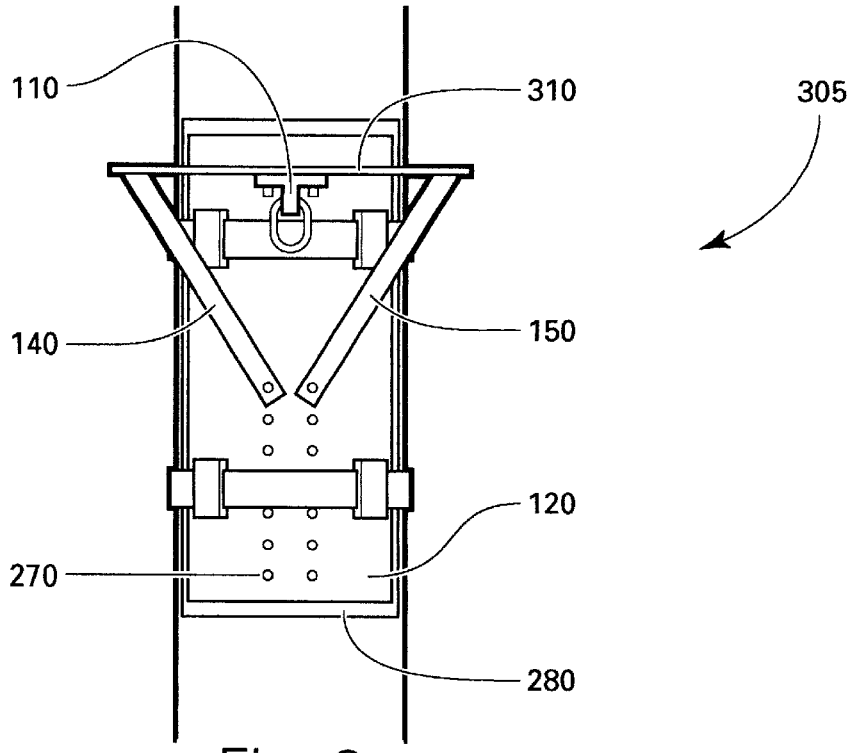
FIG. 6 is an end view of an alternate embodiment of the portable swing system of the present invention.
Figure 7:
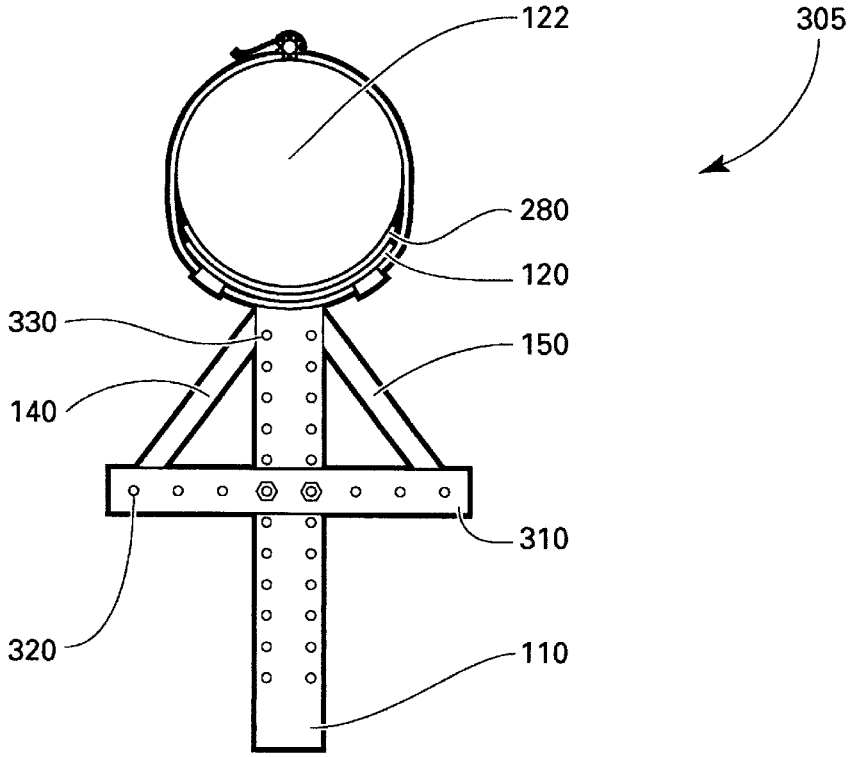
FIG. 7 is a top view of the portable swing system of FIG. 6.

In an alternate configuration of a portable swing system 305 shown in FIGS. 6 and 7, an adjustable horizontal stabilizer 310 has been secured in a perpendicular relationship to the horizontal member 110. Spaced equally on both sides of the horizontal stabilizer center line are a plurality of support bar connection holes 320 for engaging the first ends 142, 152 of the respective adjustable support bars 140, 150. Likewise, the horizontal member 110 has stabilizer connection holes 330 for adjusting the location of the horizontal stabilizer 310 on the horizontal member 110. The second ends 144, 154 of the respective first and second adjustable support bars 140, 150, connect to the vertical member 120 and the adjustable horizontal stabilizer 310 at the support bar connection holes 270, 320. The shape of the adjustable support bars may be the same as shown in FIGS. 4A, 4B, and 4C, depending on the application.

As can be seen in the FIGS. 6 and 7, the adjustable horizontal stabilizer 310 allows the first and second adjustable support bars 140, 150 to be secured to the horizontal member 110 at a greater distance away from the center of the horizontal member 110, which directly reduces torsional forces at the vertical member 120 and tree 122 interface during the swing cycle. In addition, the first and second adjustable support bars 140, 150 continue to reduce stresses by reacting to loads in the same compression/tension relationship as described above.

The present invention has several benefits. First, the portable swing system 100 is completely transportable from one tree to another. Second, the portable swing system 100 may be adjusted to secure to varying trees that do not necessarily grow in a vertical direction. Third, the portable swing system 100 has a minimal impact on the environment due to its compressible foam pad 280 and straps 250, 260. Fourth, the portable swing system 100 is designed to have a long life through the use of the tension/compression relationship of the support bars 140, 150. Fifth, the vertical member 120 has a minimal impact on the tree 122 through the distinct torsion-reducing design of the portable swing system 100.

While the present invention has been described primarily in the context of swing set systems for trees and the like, it is recognized that the present invention may also be applied to many other applications and environments. It will be obvious to those skilled in the art that various changes and modifications can be made without departing from the spirit and scope of the present invention, and it is intended to cover the claims appended hereto. All such modifications are within the scope of this invention.

What is claimed is:

1. A portable swing system, comprising:

a vertical member adapted to be secured to a support;

a horizontal member pivotally connected to said vertical member and including attachment means for supporting a suspended swing;

a first adjustable support bar having a first end and a second end, said first end connected to a first side of said horizontal member at an intermediate location between the first and second ends of the horizontal member and said second end connected to said vertical member;

a second adjustable support bar having a first end and a second end, said first end connected to a second side of said horizontal member at an intermediate location between the first and second ends of the horizontal member and said second end connected to said vertical member;

a first clamp secured to said horizontal member between the intermediate location and said second end of said horizontal member for supporting a swing;

a second clamp secured to said horizontal member between the first clamp and the second end of the horizontal member for supporting a swing;

a pair of adjustable straps for securing said vertical member to a support;

a compressible foam pad secured between said vertical member and the support for protecting the support from wear;

wherein said first adjustable support bar and said second adjustable support bar are secured to said horizontal member and said vertical member in a parallel relationship;

wherein said first and second adjustable support bars are straight; and wherein said horizontal member and said vertical member each has a plurality of circular mounting holes for connecting to said first support bar and said Second support bar and for adjusting an angle between said horizontal member and said vertical member.

2. A portable swing system, comprising:

a vertical member adapted to be secured to a support;

a horizontal member pivotally connected to said vertical member and including attachment means for supporting a suspended swing;

a first adjustable support bar having a first end and a second end, said first end connected to a first side of said horizontal member at an intermediate location between the first and second ends of the horizontal member and said second end connected to said vertical member;

a second adjustable support bar having a first end and a second end, said first end connected to a second side of said horizontal member at an intermediate location between the first and second ends of the horizontal member and said second end connected to said vertical member;

a first clamp secured to said horizontal member between the intermediate location and said second end of said horizontal member for supporting a swing;

a second clamp secured to said horizontal member between the first clamp and the second end of the horizontal member for supporting a swing;

a pair of adjustable straps for securing said vertical member to a support;

a compressible foam pad secured between said vertical member and the support for protecting the support from wear;

wherein said first adjustable support bar and said second adjustable support bar are secured to said horizontal member and said vertical member in a parallel relationship;

wherein said first and second adjustable support bars are bowed; and wherein said horizontal member and said vertical member each has a plurality of circular mounting holes for connecting to said first support bar and said second support bar and for adjusting an angle between said horizontal member and said vertical member.

* * * * *